US005199264A

United States Patent [19]

Viscovich

[11] Patent Number: 5,199,264

[45] Date of Patent: Apr. 6, 1993

[54] STEAM OPERATED TURBINE-GENERATOR INSTALLATIONS

[75] Inventor: Paul W. Viscovich, Longwood, Fla.

[73] Assignee: Westinghouse Electric Corp., Pittsburgh, Pa.

[21] Appl. No.: 653,569

[22] Filed: Feb. 11, 1991

[51] Int. Cl.[5] ..... F01K 7/22

[52] U.S. Cl. ..... 60/679; 60/680; 60/657; 122/483; 122/488

[58] Field of Search ..... 60/679, 680, 657, 646; 122/483, 488

[56] References Cited

U.S. PATENT DOCUMENTS

| | | | |
|---|---|---|---|
| 3,898,842 | 8/1975 | Luongo | 60/680 |
| 3,930,371 | 1/1976 | Schabert | 60/679 X |
| 4,298,019 | 11/1981 | Daransky et al. | 60/679 X |
| 4,589,258 | 5/1986 | von Bockh | 122/483 X |

*Primary Examiner*—Allen M. Ostrager

[57] ABSTRACT

In a power generating installation including a steam turbine-generator system, a source of steam under pressure, and a steam conditioning unit, the steam turbine-generator system including a high pressure turbine and at least one low pressure turbine, each turbine having a steam inlet and an exhaust outlet, and an output shaft coupled to all turbines, and the steam conditioning unit being connected between the exhaust outlet of the high pressure turbine and the steam inlet of each low pressure turbine and being effective to remove moisture from, and reheat, steam flowing between the exhaust outlet of the high pressure turbine and the steam inlet of the low pressure turbine, the steam conditioning unit is composed of two structurally separate devices which include a reheating device which functions exclusively to add heat to the steam and a moisture separating device which acts to remove moisture from the steam.

19 Claims, 6 Drawing Sheets

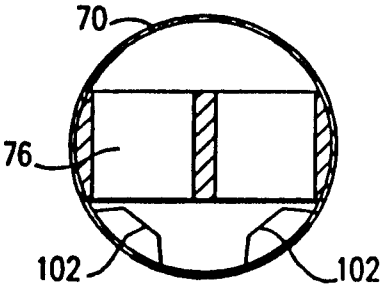
FIG. 9
FIG. 7
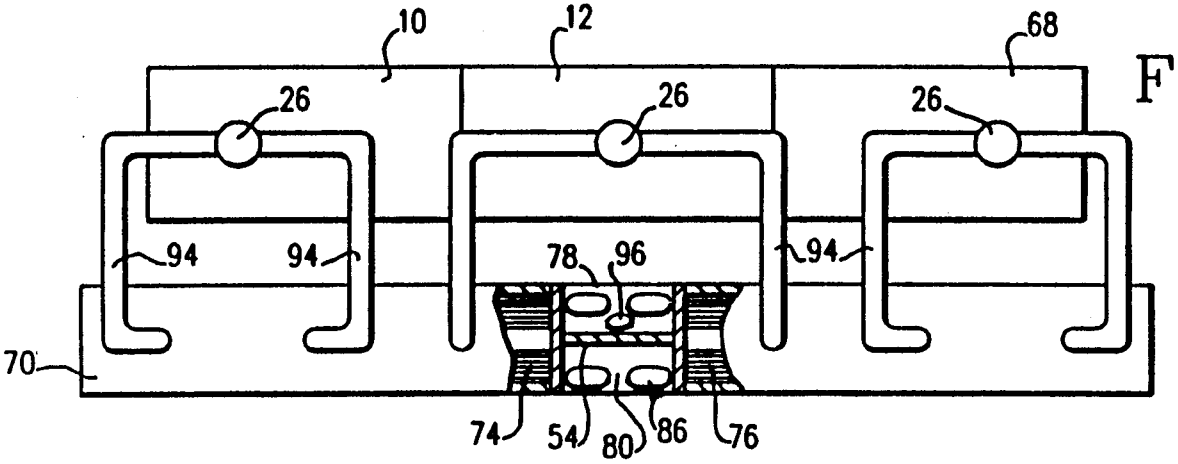
FIG. 8
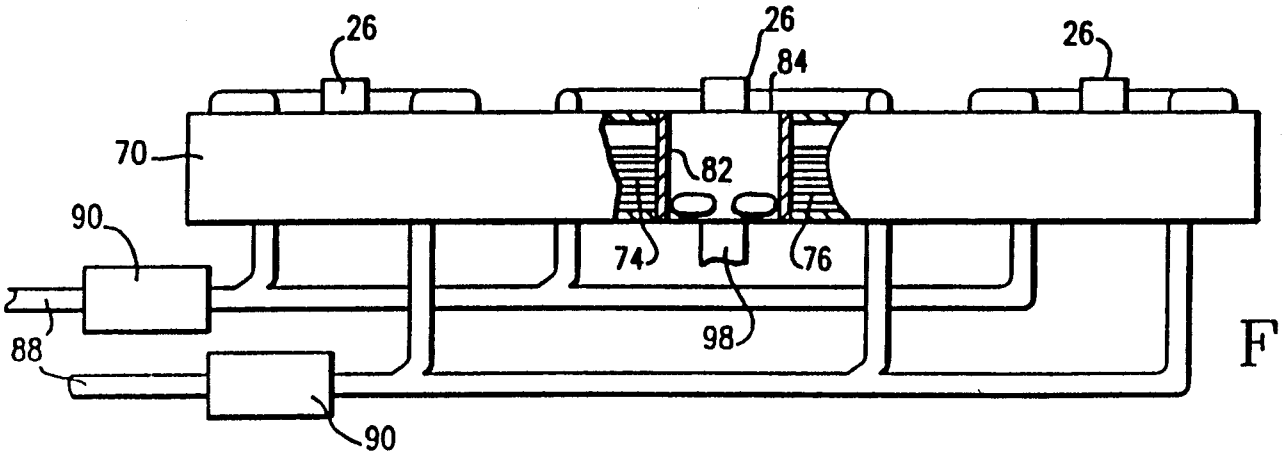

STEAM OPERATED TURBINE-GENERATOR INSTALLATIONS

BACKGROUND OF THE INVENTION

The present invention relates to turbine-generator installations, and is particularly concerned with installations in which steam for driving a series of turbines is produced by a nuclear reactor and is subject to reheating during delivery between turbines.

Among the electrical power plants utilized by the electric power industry, there are nuclear plants in which steam derived, for example, from a boiling water reactor or a pressurized water reactor is conducted through a series of steam turbines all connected to a common output shaft which drives a generator. In certain installations of this type, the steam is conducted first through a high pressure turbine, the steam leaving that turbine is subjected to moisture separation and reheated. The reheated steam is supplied to a plurality of low pressure turbines. The steam flows in parallel paths through the low pressure turbines.

The basic steam flow path of such an installation is illustrated in FIG. 1. Steam is produced by a reactor 2, which may be a boiling water reactor or a pressurized water reactor, and this steam is delivered via a supply path 4 to the steam inlet of a high pressure turbine 6. The steam leaving the steam exhaust of turbine 6 is then passed through a moisture separator-steam reheater (MSR) assembly 8 in which it is reheated by indirect heat exchange with steam derived from supply path 4, the reheated steam being delivered to the steam inlets of two low pressure turbines 10 and 12.

The exhaust from turbines 10 and 12 is conducted back to a feed water heating assembly 14 in which feed water is heated to an appropriate temperature for reintroduction into reactor 2. The heating steam delivered from path 4 to assembly 8 is also conducted, after passing through assembly 8, to feed water heater 14.

While assembly 8 is illustrated essentially as a heat exchanger, it is, according to the prior art, also provided with components for extracting moisture from the exhaust steam from turbine 6.

The physical layout of the turbines and moisture separator-reheater assemblies of a typical prior art installation is illustrated in plan view in FIG. 2. Since the physical size of a moisture separator-steam reheater device must be limited to certain dimensions primarily to satisfy existing shipping requirements, the moisture separation and reheating of the requisite quantity of steam requires the provision of two moisture separator-reheater assembly units 8. Preferably, as shown in FIG. 2, units 8 are disposed at respectively opposite sides of turbines 6, 10 and 12, so that they can be located to be serviced from the turbine deck, which is a floor on which the turbines are also supported. Appropriate piping is provided to deliver high pressure steam from supply path 4 to the steam inlet of high pressure turbine 6, and from the exhaust outlets of turbine 6 to each of units 8. Exhaust steam from high pressure turbine 6 is delivered to moisture separator-reheater assemblies 8 via conduits 16, which lead to the bottom of assemblies 8, while reheated steam is delivered to the steam inlets of low-pressure turbines 10 and 12 via conduits 18 which emerge from the top of assemblies 8. According to conventional practice, conduits 18 extend in directions normal to the axis of the turbine shaft.

In many installations, it is necessary to effect deareation of the steam and, with the layout illustrated in FIG. 2, there is no room for locating a deareator at level of the turbine deck. This means that the deareator must be located at a different level, which increases servicing problems.

Moreover, the component layouts currently in use, an example of which is shown in FIG. 2, are disadvantageous in that they limit access to turbines 10 and 12, reduce the amount of working space available on the turbine floor during routine maintenance operations, and will result in uneven thermal loading of turbines 10 and 12 if one of assemblies 8 must be removed from service during plant operation.

In certain known installations typified by FIG. 2, the reheater components of each assembly are composed of a plurality of U-shaped tubes which conduct reheating steam and which are oriented to each lie in a vertical plane. This orientation gives rise to drainage problems in the lower leg of each tube, requiring the provision of additional components in the assembly. By way of example, it is known to provide a scavenging steam vent condenser which converts what is in reality a two-pass bundle into a modified four-pass arrangement, thereby increasing scavenging steam flow in the lower legs of the U-shaped tubes.

SUMMARY OF THE INVENTION

It is an object of the present invention to obviate the above disadvantages and difficulties.

Another object of the invention is to reduce the space occupied at the turbine deck by the moisture separating and reheating apparatus.

A further object of the invention is to provide space on the turbine deck for convenient positioning of an added component, such as a deareator.

A further object of the invention is to improve the routing of steam to the turbine inlets.

Yet another object of the invention is to eliminate problems associated with the reheater apparatus.

The above and other objects are achieved, according to the present invention, in a power generating installation including a steam turbine-generator system, a source of steam under pressure, and steam conditioning means, wherein the steam turbine-generator system includes a high pressure turbine and at least one low pressure turbine, each turbine having a steam inlet and an exhaust outlet, and an output shaft coupled to all turbines, and the steam conditioning means are connected between the exhaust outlet of the high pressure turbine and the steam inlet of each low pressure turbine and comprise means for removing moisture from, and reheating, steam flowing between the exhaust outlet of the high pressure turbine and the steam inlet of the low pressure turbine, by the improvement wherein the means for removing moisture and reheating comprise two structurally separate devices which include a reheating device which functions exclusively to add heat to the steam and a moisture separating device which acts to remove moisture from the steam.

BRIEF DESCRIPTION OF THE DRAWING

FIGS. 7 and 8 are, respectively, a plan view and a side elevational view, each partly broken away, illustrating a second embodiment of the invention.

FIG. 9 is a cross-sectional end view of the reheater of FIGS. 7 and 8.

DESCRIPTION OF THE PREFERRED EMBODIMENTS

Figure 2:
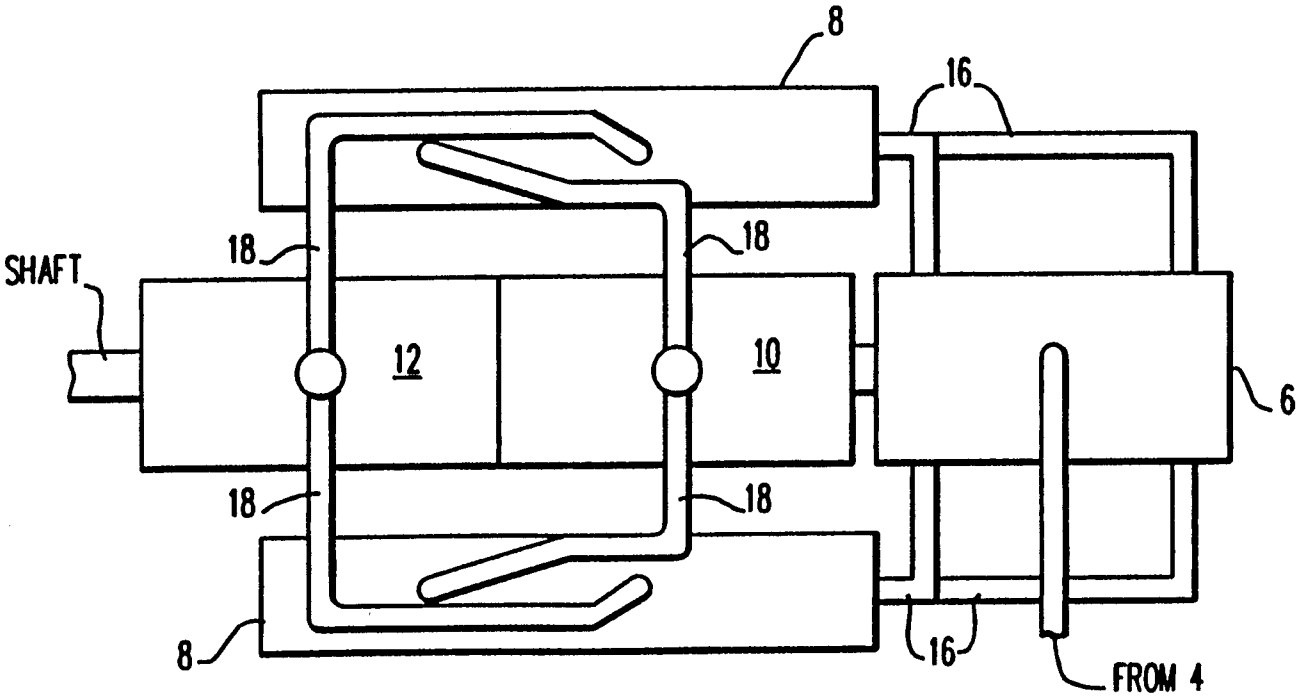
PRIOR ART FIG. 2
FIG. 2 is a plan view showing the layout of turbines and associated components in a conventional power generating plant.

According to the present invention, the prior art assemblies for removing moisture from, and reheating, steam are replaced by at least one assembly which is constructed to perform exclusively a reheating operation and a separate assembly which effects moisture removal. It has been found that when this strategy is adopted, a single unit having the same outer dimensions as a prior art moisture separator-steam reheater assembly can perform the reheating function of the two assemblies illustrated in FIG. 2 for a turbine-generator installation of a given size.

Figure 3:
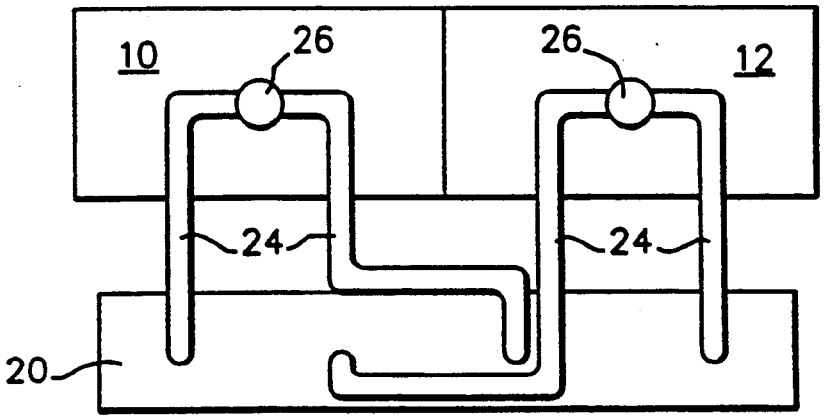
FIG. 3 is a plan view of a portion of an installation according to one preferred embodiment of the present invention.
Figure 4:
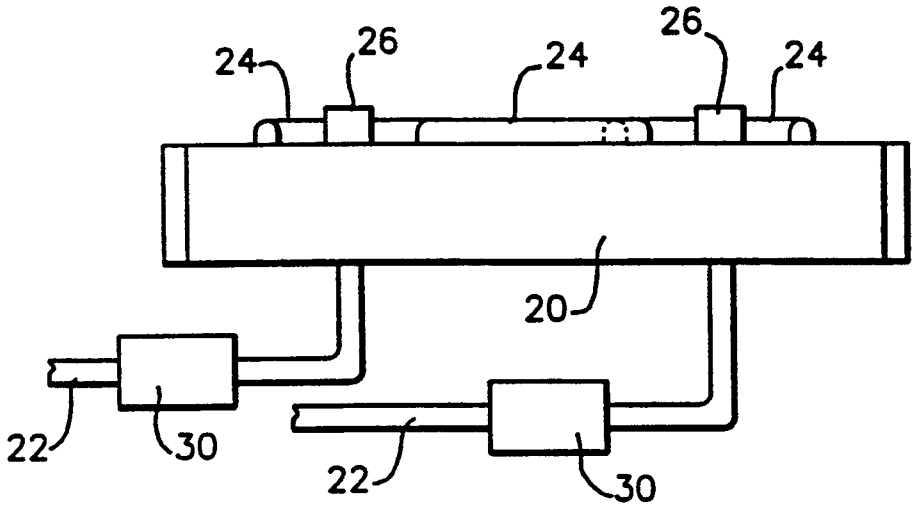
FIG. 4 is a side elevational view of a portion of the structure shown in FIG. 3.

One embodiment of an arrangement according to the present invention is illustrated in FIGS. 3 and 4 which are, respectively, a plan view and a side elevational view. As shown therein, a single reheater 20 is disposed along one side of the arrangement of low pressure turbines 10 and 12. Exhaust steam from high pressure turbine 6 (not shown in FIGS. 3 and 4) is delivered via conduits 22 to the bottom of reheater 20 and after the steam is reheated, it is delivered, via conduits 24, to the steam inlets 26 of turbines 10 and 12. By supplying reheated steam to each low pressure turbine via two conduits 24, the diameters of conduits 24 can be maintained consistent with those of the other conduits in the steam system. In addition, conduits 24 can be configured to deliver steam to inlets 2 in directions parallel to the axis of rotation of the turbine shaft, which provides a more efficient steam delivery. The configuration of conduits 24 results in fewer conduit bends and smaller pressure losses than would exist if the conduits had to loop around the turbines.

Thus, with the arrangement illustrated in FIGS. 3 and 4, the region at the other side of turbines 10 and 12 is available for disposition of an additional steam conditioning component, such as a deareator.

In order to achieve the required moisture separation, a moisture separator 30 may be disposed in the steam path provided by each conduit 22. Since moisture separators require relatively little maintenance, they can be conveniently disposed below the turbine deck.

Figure 5:
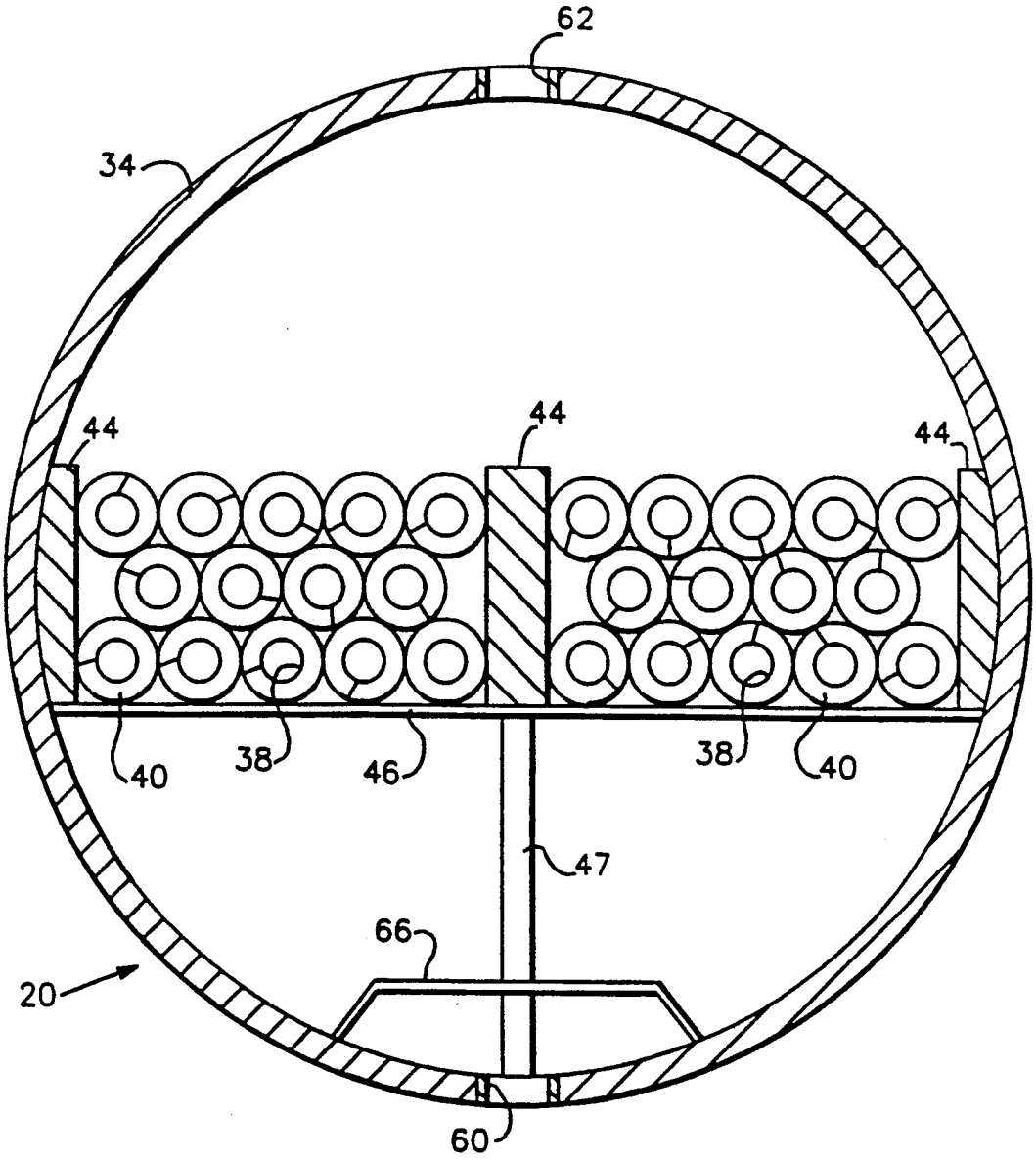
FIG. 5 is a cross-sectional end view of the interior of a reheater according to a preferred embodiment of the present invention, taken along plane V—V of FIG. 6.
Figure 6:
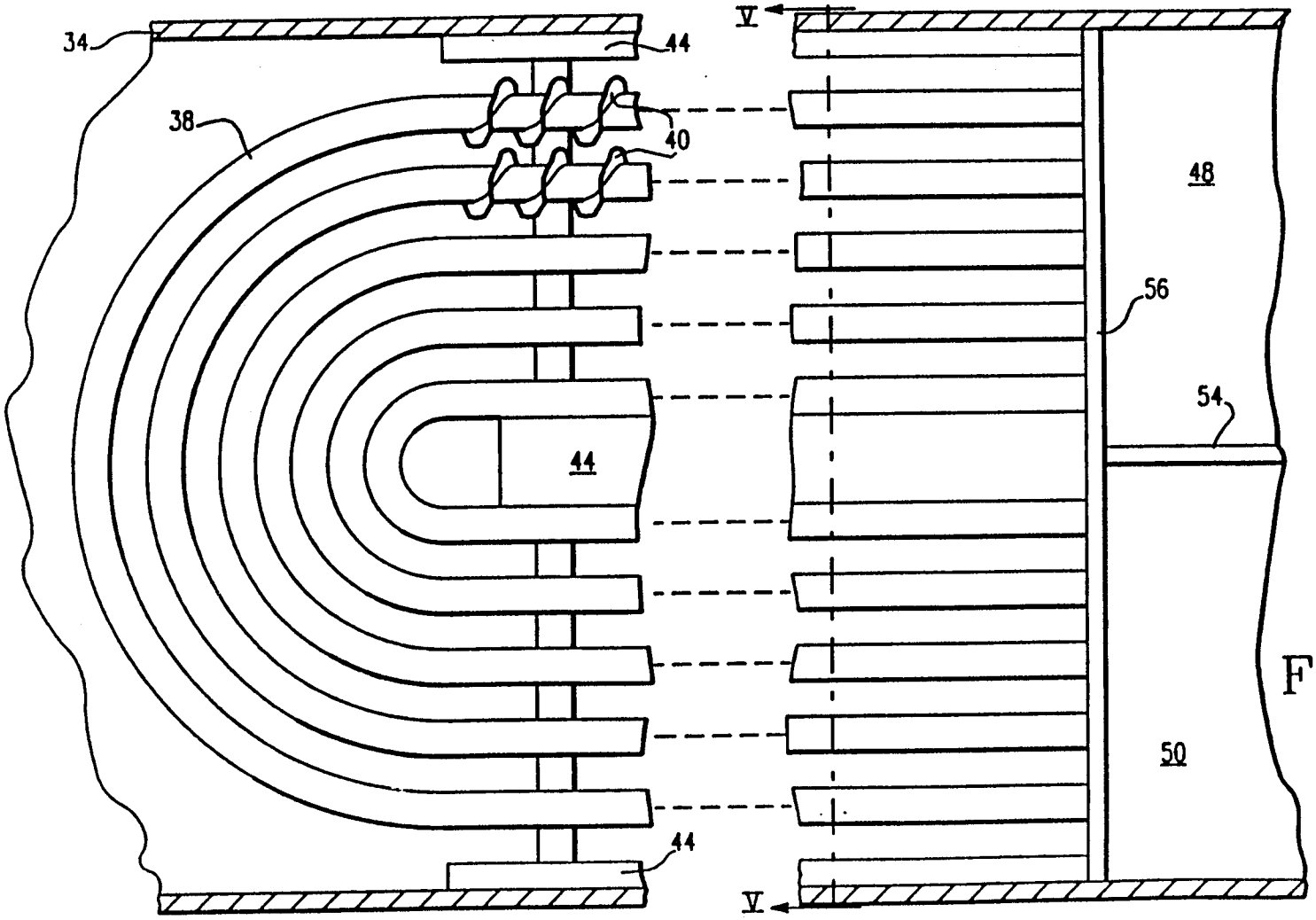
FIG. 6 is a cross-sectional plan view of a portion of the interior of the reheater of FIG. 5.

One preferred form of construction of the interior of reheater 20 according to the present invention is illustrated in FIGS. 5 and 6, FIG. 5 being a cross-sectional end view and FIG. 6 being a cross-sectional top plan view. FIG. 5 is taken along the cross-section plane V—V of FIG. 6.

The reheater illustrated in FIGS. 5 and 6 includes a cylindrical housing 34 containing a plurality of tubes 38 each of which is surrounded by a helical heat transfer fin 40. Only a few turns of two of fins 40 are illustrated in FIG. 6.

Each tube 38 has a U-shape, with the axis of the tube lying in a horizontal plane. Tubes 38 are stacked in a plurality of layers, as best seen in FIG. 5, preferably with the imaginary cylinders circumscribing fins 40 in close proximity to one another to provide a high heat transfer capacity in a limited space. The axes of tubes 38 in one horizontal row are interposed between the axes of tubes 38 in the vertically adjacent horizontal rows. With this arrangement, fins 40 present a large heat transfer area to steam flowing upwardly through housing 20.

Because of the horizontal orientation of each tube 38, the scavenging problems described above are effectively eliminated. In addition, this arrangement promotes more uniform heat transfer since, for each tube, reheat steam contacting that tube has the same temperature adjacent both legs of the tube. In addition, since both legs of a tube 38 are exposed to reheating steam having the same temperature, the propensity for unequal thermal growths is eliminated.

Moreover, the tube orientation according to the invention opens the possibility of giving each tube an internal diameter tailored to conform to the hydraulic and thermodynamic requirements at each level within the heat exchanger. The temperature difference between reheating steam, which flows through the tube, and reheat steam, which flows around the tubes, decreases as the reheat steam flows upwardly through housing 34. Therefore, tubes 38 can be dimensioned so that the mass flow rate of reheating steam decreases from one horizontal row of tubes 38 to the next higher row.

The region at the center of the bundle of tubes 38 and the regions at the peripheries of the bundles are contacted by panels 44 which provide support for tubes 38 and which act as seals to prevent the flow of steam through regions where it would not be in contact with any fins 40. The tube bundle is primarily supported by one or more horizontal support members 46.

Tubes 38 may be further supported by additional vertical supports, such as post 47, extending between the center panel 44 and the bottom of housing 20. Other suitable types of support structures may also be provided.

Referring to FIG. 6, at one end of housing 34 there are provided a reheating steam inlet chamber 48 and a reheating steam outlet chamber 50, chambers 48 and 50 being separated by a partition wall 54.

Figure 1:
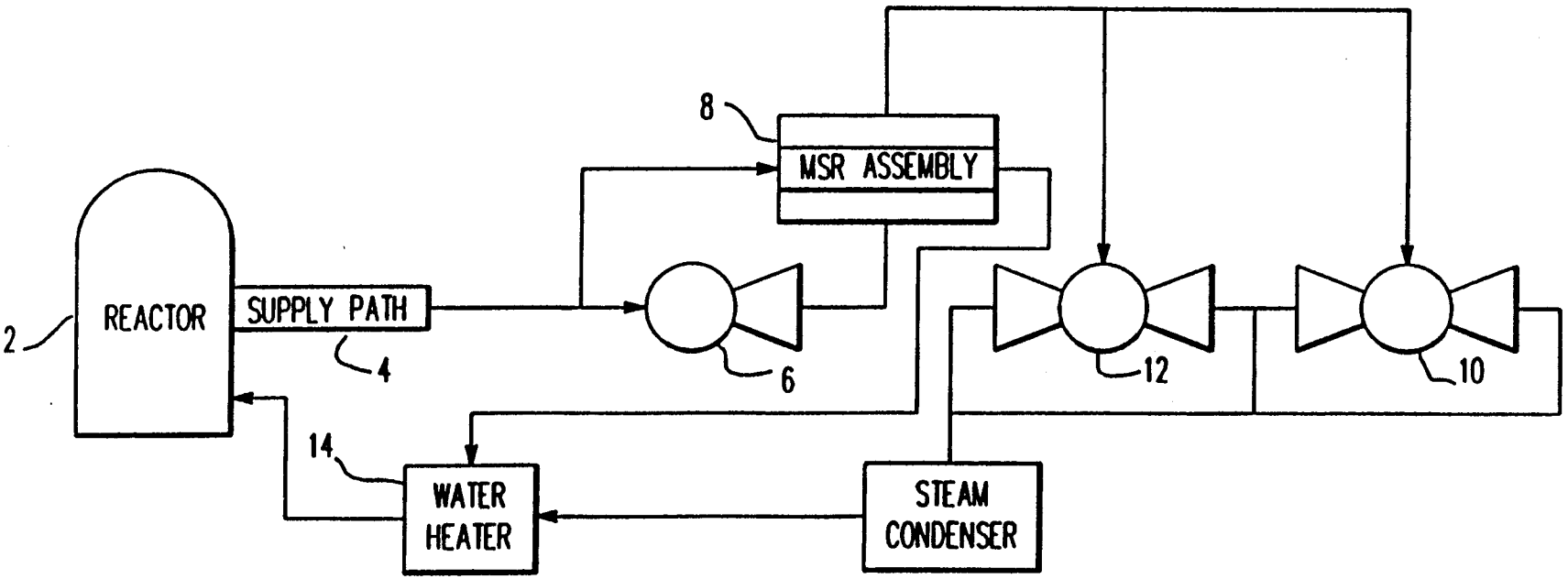
PRIOR ART FIG. 1
FIG. 1 is a schematic diagram of a system for conducting steam between a reactor and a plurality of turbines in a conventional power generating plant.

Each tube 38 has an inlet end communicating with chamber 48 and an outlet end communicating with chamber 50, via a manifold plate 56 provided with a steam flow passage for each end of each tube 38. Referring back to FIG. 1, steam may be supplied to chamber 48 from supply path 4 and conducted from chamber 50 to feed water heater 14.

Referring to FIG. 5, housing 20 is further provided with one or more cold reheat steam inlet passages 60 located at the bottom of housing 20, and a plurality of hot reheat outlet passages 62, located at the top of housing 20. Consistent with the embodiment illustrated in FIGS. 3 and 4, four inlet passages 60 and four outlet passages 62 may be provided.

Surrounding inlet passage 60 there is an impact baffle and longitudinal flow guide 66 whose longitudinal dimension is parallel to the axis of housing 20 and which is open at its longitudinal ends to permit flow of cold reheat steam upwardly through housing 20 and past fins 40.

A second embodiment of the invention is illustrated in schematic form in FIGS. 7, 8 and 9, FIG. 7 being a plan view, FIG. 8 being a side elevational view and FIG. 9 being an axial cross-sectional view of the reheater 70 according to the second embodiment. In FIGS. 7 and 8 a portion of the reheater is broken away to illustrate the heat transfer tubes disposed therein.

The embodiment illustrated in FIGS. 7-9 is constructed to supply reheated steam to three low pressure turbines 10, 12 and 68 which are to be supplied in parallel from a single reheater 70 which, because it must have a larger steam delivery capacity, is longer than reheater 20 and contains two bundles 74 and 76 of U-shaped tubes.

Each bundle 74, 76 has the form of the bundle illustrated in FIGS. 5 and 6 and the two bundles 74 and 76 are arranged so that their semicircular ends are at respective ends of reheater 70 and their inlet and outlet ends open to a common steam inlet chamber 78 and a common steam outlet chamber 80 located at the center of reheater 70. Chambers 78 and 80 are separated by a partition wall 54 and each tube bundle 74, 76 is associated with a respective manifold plate 82, 84. In the region of chambers 78 and 80, reheater 70 is provided with manways 86 via which access may be gained to chambers 78 and 80 for maintenance and repair purposes.

Cold reheat steam is supplied from the two exhaust ends of the associated high pressure turbine (not illustrated in FIGS. 7 and 8) via two conduits 88 each containing a respective moisture separator 90. At the outlet of each moisture separator 90, each conduit 88 branches into three outlets each communicating with a respective inlet passage provided in the bottom of reheater 70. Hot reheat steam is delivered to the steam inlets 26 of low pressure turbines 10, 12 and 68 via six outlet conduits 94, two for each low pressure turbine. Here again, conduits 94 are configured to deliver steam to inlets 26 in directions parallel to the axis of rotation of the turbine shaft.

In the region of chamber 78, reheater 70 is provided with an inlet passage 96 via which steam is delivered from supply path 4 via a conduit 98. After this steam passes through the tube bundles 74 and 76, it is withdrawn from chamber 80 and returned to the feed water heater via a conduit 100.

As shown in FIG. 9, reheater 70 is provided, at its interior, with baffles 102, each associated with a respective cold reheat steam inlet passage. Each baffle 102 may be constructed in the same manner as baffle 66 shown in FIG. 4.

While the description above refers to particular embodiments of the present inveniton, it will be understood that many modificatinos may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a power generating installation including a steam turbine-generator system, a source of steam under pressure, and steam conditioning means, wherein the steam turbine-generator steam includes a high pressure turbine and at least one low pressure turbine, each turbine having a team inlet and an exhaust outlet, and an output shaft coupled to all turbines, and the steam conditioning means are connected between the exhaust outlet of the high pressure turbine and the steam inlet of the low pressure turbine and comprise means for removing moisture from, and reheating, steam flowing between the exhaust outlet of the high pressure turbine and the steam inlet of the low pressure turbine, the improvement wherein said means for removing moisture and reheating comprise two structurally separate devices which include a reheating device which functions exclusively to add heat to the steam and a moisture separating device which acts to remove moisture from the steam, and said reheating device comprises: a housing; a plurality of tubes arranged in a bundle in said housing; and conduit means for conducting steam from said source of steam into said tubes and for directing steam from the exhaust outlet of said high pressure turbine, through said housing and around said tubes, and to the steam inlet of at least one low pressure turbine.

2. An installation as defined in claim 1 wherein the steam turbine-generator system includes a turbine shaft connected to be rotated by the high-pressure and low pressure turbines and said installation includes only one reheating device disposed entirely to one side of said turbines and at substantially the same elevation as said turbines.

3. An installation as defined in claim 2 wherein said moisture separating device is disposed at a lower elevation than said reheating device.

4. An installation as defined in claim 2 wherein said plurality of tubes are U-shaped tubes and each said tube has a longitudinal axis which is located entirely in a horizontal plane.

5. An installation as defined in claim 1 wherein said plurality of tubes are U-shaped tubes and each said tube has a longitudinal axis which is located entirely in a horizontal plane.

6. In a power generating installation including a steam turbine-generator system, a source of steam under pressure, and steam conditioning means, wherein the steam turbine-generator system includes a high pressure turbine and at least one low pressure turbine, each turbine having a steam inlet and an exhaust outlet, and an output shaft coupled to all turbines, and the steam conditioning means are connected between the exhaust outlet of the high pressure turbine and the steam inlet of the low pressure turbine and comprise means for removing moisture from, and reheating, steam flowing between the exhaust outlet of the high pressure turbine and the steam inlet of the low pressure turbine, the improvement wherein said means for removing moisture and reheating comprise two structurally separate devices which include a reheating device which functions exclusively to add heat to the steam and a moisture separating device which acts to remove moisture from the steam, and said reheating device comprises: a housing containing partitioning means dividing the interior of said housing into first, second and third steam flow chambers, said housing having a steam entrance passage and a steam exit passage, both communicating with said first chamber, a reheating steam inlet passage communicating with said second chamber, and a reheating steam outlet passage communicating with said third chamber; and a plurality of U-shaped tubes forming a tube bundle and extending across said first chamber, each said tube having a steam inlet end communicating with said second chamber and a steam outlet end communicating with said third chamber; wherein said steam entrance passage is connected to receive steam from said exhaust outlet of said high pressure turbine, said steam exit passage is connected to supply steam to said steam inlet of said at least one low pressure turbine, said reheating steam inlet passage is connected to receive steam from said source of steam under pressure and said reheating steam outlet passage is connected to return steam and condensate to said source of steam under pressure.

7. An installation as defined in claim 6 wherein each said tube is provided with a heat transfer fin.

8. An installation as defined in claim 6 wherein said tubes are arranged to permit passage of steam through said first chamber between said tubes.

9. An installation as defined in claim 8 wherein each said tube is arranged in a horizontal plane.

10. An installation as defined in claim 6 wherein said partitioning means divide the interior of said housing into two first steam flow chambers separated from one another by said second and third chambers, said plurality of tubes is arranged in two tube bundles, each bundle extending across a respective first chamber, said steam inlet ends of said tubes of both said bundles communicate with said second chamber, and said steam outlet ends of said tubes of both said bundles communicate with said third chamber.

11. An installation as defined in claim 10 wherein each said tube is provided with a heat transfer fin.

12. An installation as defined in claim 10 wherein said tubes are arranged to permit passage of steam through each said first said chamber between said tubes.

13. An installation as defined in claim 12 wherein each said tube is arranged in a horizontal plane.

14. An installation as defined in claim 10 wherein said steam turbine-generator system includes three said low pressure turbines and said steam conditioning means comprise a plurality of steam delivery conduits each coupled to said steam inlet of a respective low pressure turbine.

15. An installation as defined in claim 14 wherein each said conduit has an outlet portion oriented to deliver steam to said steam inlet of a respective low pressure turbine along a path substantially parallel to the axis of said output shaft.

16. An installation as defined in claim 15 wherein there are two steam delivery conduits coupled to said steam inlet of each said low pressure turbine.

17. An installation as defined in claim 6 wherein said steam conditioning means comprise at least one steam delivery conduit having an outlet portion coupled to said steam inlet of each said low pressure turbine for delivering steam to each said low pressure turbine along a path substantially parallel to the axis of said output shaft.

18. An installation as defined in claim 17 wherein said steam turbine-generator system includes two said low pressure turbines and said steam conditioning system comprises four of said steam delivery conduits, two respective steam delivery conduits being coupled to each said low pressure turbine.

19. In a power generating installation including a steam turbine-generator system, a source of steam under pressure, and steam conditioning means, wherein the steam turbine-generator system includes a high pressure turbine and at least one low pressure turbine, each turbine having a steam inlet and an exhaust outlet, and an output shaft coupled to all turbines, and the steam conditioning means are connected between the exhaust outlet of the high pressure turbine and the steam inlet of the low pressure turbine and comprise means for removing moisture from, and reheating, steam flowing between the exhaust outlet of the high pressure turbine and the steam inlet of the low pressure turbine, the improvement wherein said means for removing moisture and reheating comprise two structurally separate devices which include a reheating device which functions exclusively to add heat to the steam and a moisture separating device which acts to remove moisture from the steam, and said steam conditioning means comprise at least one steam delivery conduit having an outlet portion coupled to said steam inlet of said low pressure turbine for delivering steam to said low pressure turbine along a path substantially parallel to the axis of said outlet shaft.

* * * * *